United States Patent [19]

Bower et al.

[11] Patent Number: 4,683,938

[45] **Date of Patent: * Aug. 4, 1987**

[54] METHOD AND APPARATUS FOR THE CONTINUOUS PRODUCTION OF STRIP USING OSCILLATING MOLD ASSEMBLY

[75] Inventors: Terry F. Bower, Needham; M. Ronald Randlett; George Shinopulos, both of Burlington, all of Mass.

[73] Assignee: Kennecott Corporation, Cleveland, Ohio

[ * ] Notice: The portion of the term of this patent subsequent to Nov. 11, 1997 has been disclaimed.

[21] Appl. No.: 825,662

[22] Filed: Feb. 3, 1986

Related U.S. Application Data

[60] Division of Ser. No. 708,115, Mar. 5, 1985, Pat. No. 4,612,971, which is a continuation of Ser. No. 184,163, Sep. 4, 1980, abandoned, which is a continuation-in-part of Ser. No. 956,793, Nov. 1, 1978, Pat. No. 4,232,727, which is a continuation-in-part of Ser. No. 928,881, Jul. 28, 1978, Pat. No. 4,211,270.

[51] Int. Cl.[4] ..... B22D 11/04; B22D 11/70

[52] U.S. Cl. ..... 164/413; 164/417

[58] Field of Search ..... 164/476, 477, 76.1, 164/417, 454, 413; 226/118; 72/366; 148/2

[56] References Cited

U.S. PATENT DOCUMENTS 2,815,551 12/1957 Hessenberg et al. ..... 164/416 X

OTHER PUBLICATIONS

E. Germann, "Nepreryvnoe Lit'e", 5 Continuous Casting, 1961, pp. 512–513.

*Primary Examiner*—Kuang Y. Lin

*Attorney, Agent, or Firm*—H. M. Snyder; G. R. Plotecher

[57] ABSTRACT

Disclosed is an apparatus and method for the integrated, continuous, high speed manufacture of metallic strip, especially brass, from a melt. The apparatus comprises a chilled casting mold in liquid communication with a melt, means for drawing a rod through the mold at a constant rate and means for oscillating the mold in a pattern of forward and reverse strokes with respect to the direction of travel of the rod. Conversion of the rod to strip comprises flattening in a hot rolling mill, and quenching. In accordance with known procedures, the produced strip can be further reduced in cross section in one or more cold rolling mill or other hot rolling mills if desired.

11 Claims, 18 Drawing Figures

METHOD AND APPARATUS FOR THE CONTINUOUS PRODUCTION OF STRIP USING OSCILLATING MOLD ASSEMBLY

CROSS REFERENCE TO A RELATED APPLICATION

This is a division, of application Ser. No. 708,115, filed Mar. 5, 1985, now U.S. Pat. No. 4,612,971 which in turn is a continuation of U.S. application Ser. No. 184,163 filed Sept. 4, 1980, now abandoned, which is a continuation-in-part of copending application Ser. No. 956,793, filed Nov. 1, 1978, now U.S. Pat. No. 4,232,727 which, in turn, is a continuation-in-part of application Ser. No. 928,881, filed July 28, 1978, now U.S. Pat. No. 4,211,270 the teachings of both of which are incorporated herein by reference.

BACKGROUND OF THE INVENTION

This invention relates to the manufacture of metallic strip and more particularly to an apparatus and method for integrated, continuous, high speed manufacture of finished metallic strip from a metallic melt.

It is well known in the art to cast indefinite lengths of metallic rods or strands from a melt by drawing the melt through a cooled mold. Known casting techniques include down-casting, horizontal or inclined casting and upcasting. The above referenced application Ser. No. 928,881 discloses a mold assembly and method for the continuous up-casting of high quality metallic rods, particularly those of copper and copper alloys including brass, at production speeds many times faster than those previously attainable with closed mold systems.

It is known to oscillate a continuous casting mold to provide stripping action to facilitate the movement of the newly cast rod through the mold and more importantly, when the rate of advancement of the mold during a portion of the cycle is greater than that of the rod being cast, to prevent tension tears in the solidifying skin. To produce high quality rod, it is necessary that mold motion be substantially parallel to the direction of travel of the rod through the mold. Moreover, creating the casting strokes by mold oscillation allows the rod to be withdrawn from the mold at a constant rate, thereby facilitating further processing operations after casting, for example, the conversion of rod to strip. The rolling mills for such a conversion from rod to strip require the working material to be moving at a uniform velocity if heavy reductions are to be made. A particularly suitable design for an oscillating mold assembly is that disclosed in co-pending U.S. application Ser. No. 117,028, for "Oscillating Mold Casting Apparatus", having a common assignee as this application. The teachings of that application are hereby incorporated by reference.

Conventional techniques for producing brass strip are cumbersome and time consuming. Often, more than forty separate steps are required to produce a finished thin strip taking as long as forty days, including waiting time between processing machines.

It is, therefore, an object of the present invention to provide an apparatus and method for the integrated, continuous, high speed production of high quality, hot rolled metallic strip starting from a melt.

It is another object of the present invention to provide such an apparatus, compact in size, which costs much less than conventional strip-making installations.

A still further object of the present invention is to provide such an apparatus capable of producing very thin metallic strip at less cost than is possible with conventional techniques.

Yet another object of the present invention is to provide an apparatus and method for the continuous production of metal strip from a melt in which a metal rod is cast at a constant velocity and is fed to a rolling mill for conversion to strip.

SUMMARY OF THE INVENTION

The apparatus for integrated, continuous, high speed manufacture of finished metallic strip from a melt, typically of copper and copper alloys such as brass, comprises two elements. The first is a casting apparatus, including an oscillating mold assembly as disclosed in co-pending application Ser. No. 117,028, capable of continuous high speed production of high quality metallic rod. The second element is the processing apparatus for the continuous conversion of the rod into strip.

The rod casting means comprises an oscillating chilled mold assembly in liquid communication with a melt. Hydraulic means are employed to oscillate the mold with respect to a fixed reference position in the direction of travel of the rod through the mold. A pair of rolls pulls the rod from the mold at a substantially constant speed with respect to the same fixed reference position. The mold oscillation creates the same effect as withdrawing the rod itself in a pattern of forward and reverse strokes. The cycle of forward and reverse strokes makes possible the production of high quality rods by aiding the formation of the casting skin, preventing casting termination, and compensating for contraction of the casting within the die as it cools.

A transducer maintains synchronization of the rolling mill speed to equal the forward casting speed multiplied by a reduction constant.

For processing of the rod into hot rolled strip, the direction of travel of the rod can be changed. After the rod emerges from the rolls which withdraw the rod, the direction of travel is changed by 70°100°, preferably 90°, by guiding the rod through a plurality of guide rolls arranged on an arcuate path. Straightening rolls guide the rod at substantially constant velocity to the processing stations for converting the rod to strip.

These processing stations include a reheating station for raising the temperature of the rod for hot rolling, if necessary, at least one hot rolling mill for flattening the rod into strip, a quench chamber for cooling the strip and a winder for coiling the finished strip. In addition to these stations, other procedures may be carried out, such as cold rolling and annealing, as required. For example, additional hot and cold rolling mills are employed for the production of thin strip material, down to 0.01 inch or less. One or more edgers for controlling strip width along with an edge conditioning unit for shaping the edge may be necessary as well. Of course, a reheater is only necessary when the temperature of rod drops to below the hot rolling range.

Brushes for cleaning the strip surface before cold rolling and various gauges for measuring the strip width, thickness and flatness may also be required. The finished strip is then coiled by a winder. The whole process from melt to solid hot rolled strip takes approximately one minute to complete.

Alternatively, because the rod is being advanced at a substantially constant speed relative to a fixed position (the strokes being provided by mold oscillation), the change in direction of rod travel may be avoided to accommodate building constraints. In this case, the rod proceeds directly to the processing stations for conversion into strip. It should be noted that the withdrawal rolls of the caster may themselves perform the hot rolling, either in line, or with a corner that constrains the cast rod. These and other objects and features of the invention will become apparent to those skilled in the art from the following detailed description which should be read in light of the accompanying drawing.

DESCRIPTION OF THE PREFERRED EMBODIMENTS

Figure 1:
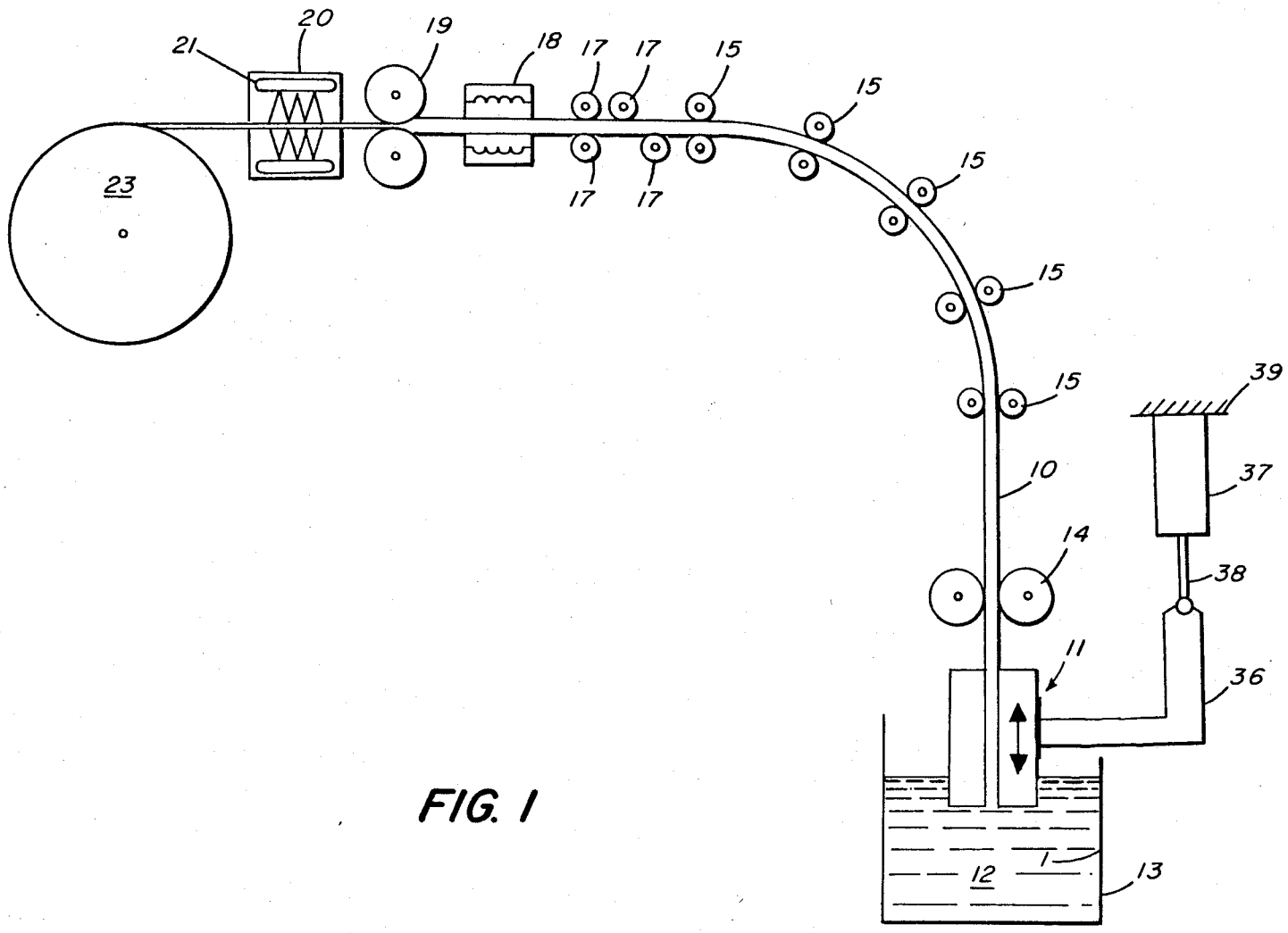
FIG. 1 is a simplified diagrammatic illustration of one embodiment of the present invention.

At the outset the invention is described in its broadest overall aspects with a more detailed description following. Referring to FIG. 1, a metallic rod 10 is withdrawn through an oscillating chilled mold 11 immersed in a melt 12. The melt, preferably copper or a copper alloy including brass, is contained within a casting furnace 13. The rod 10 is withdrawn by means of withdrawal rolls 14 which frictionally engage the rod and advance it at a substantially constant speed with respect to a fixed reference position. Generally, this speed is in the range of from 200 to 400 inches per minute. The chilled mold 11 is supported by a carriage assembly 36 which in turn is attached to a piston shaft 38 of an hydraulic cylinder 37. It is understood that other linear actuators can be used. The hydraulic cylinder 37 is attached rigidly to a superstructure 39. The mold 11, immersed in the melt 12 contained within the casting furnace 13, is thus movable co-linearly with the rod 10. An electronic programmer (not shown) controls the motion of the carriage assembly 36 through conventional automatic control techniques. Specifically, the mold 11 is caused to oscillate about the same fixed reference position as mentioned above.

Guide rolls 15 arranged on an arcuate path change the direction of rod travel by, for example, 90°.

The rod 10 is straightened as it passes through a series of straightening rolls 17 and is guided to a reheating chamber 18 where it is reheated to a temperature for hot rolling. From the reheating chamber 18, the rod 10 passes through the rolling mill 19 where it is flattened into strip. Thereafter, the strip is quenched in a quench chamber 20. Perforated manifolds 21 within the quench chamber 20, supplied with water by conventional means (not shown), spray the strip 10 as it passes through. Beyond the quench chamber, the strip is coiled by a winder 23 onto a drum.

A tachometer (not shown) on the rod 10 below the drive rolls 14 provides a signal to control roll velocity as a function of reduction ratio; this allows the casting withdrawal rate to be controlled as required. The combination of mold oscillation and constant speed rod advancement creates the necessary forward and reverse strokes for rod production.

Figure 16:
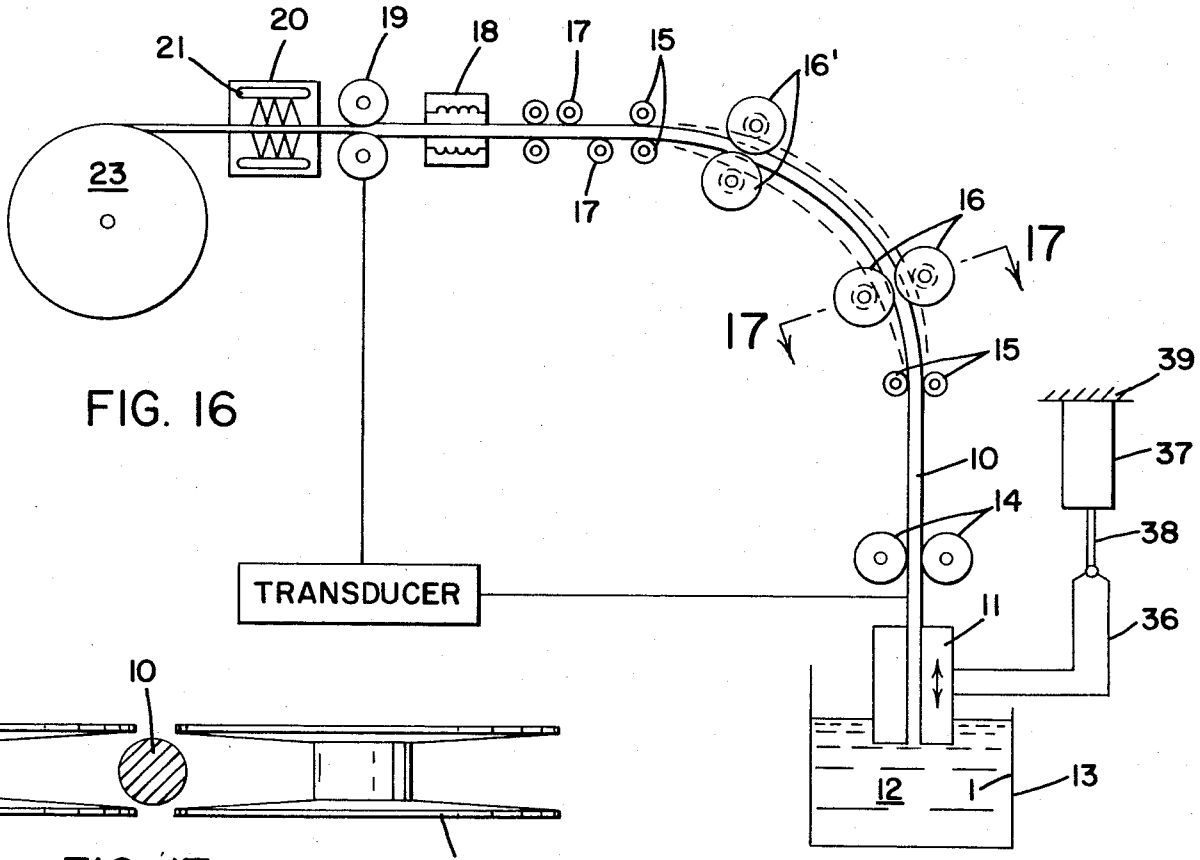
FIG. 16 is a simplified diagrammatic illustration of another embodiment of the present invention.
Figure 17:
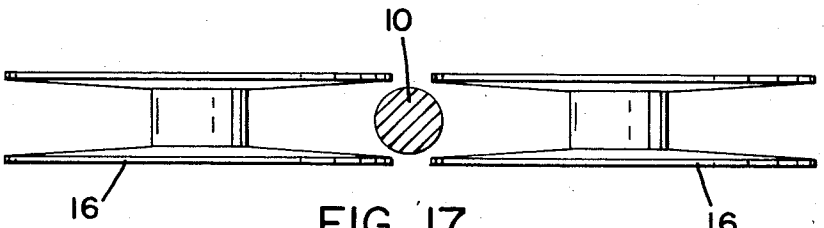
FIG. 17 is a view along line 17—17 of FIG. 16.

In an alternate embodiment, as shown in FIG. 16, rod 10 is withdrawn by means of withdrawal rolls 14 which frictionally engage the rod and advance it at a substantially constant speed with respect to a fixed reference position in the same manner as in the embodiment of FIG. 1. Also, as with the FIG. 1 embodiment, guide rolls 15 are arranged on an arcuate path to change the direction of rod travel, which change in direction of travel allows slack to develop through lateral deflection of rod 10 near the midpoint of the arcuate path. The slack is accommodated by slack accommodating rolls 16,16' which have deeply recessed grooves in their circumferential faces as shown in FIG. 17. The grooves thus retain the rod in a direction perpendicular to the plane of FIG. 16, while allowing rod deflection in the plane of FIG. 16.

Figure 18:
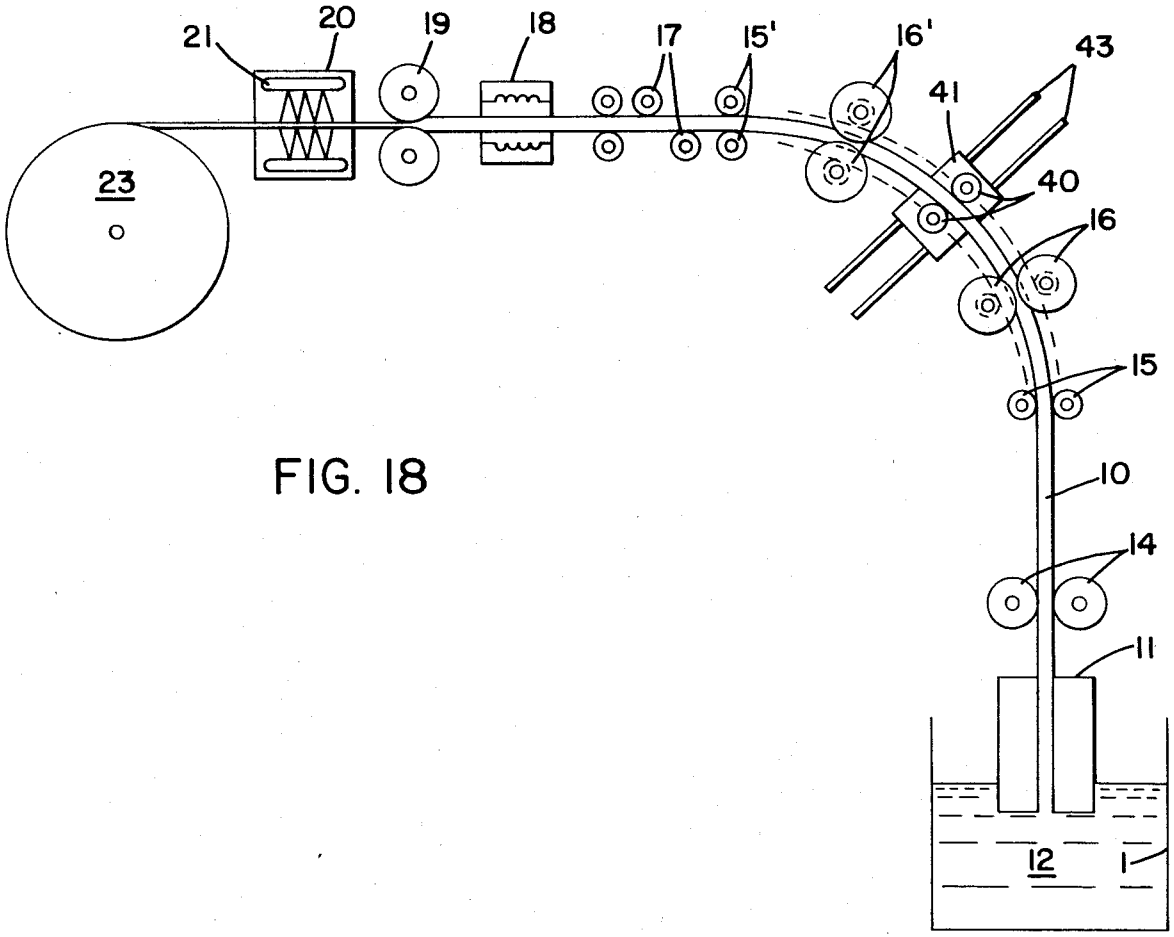
FIG. 18 is a simplified diagrammatic illustration of still another embodiment of the invention.

In still another embodiment, shown in FIG. 18, there are located between the slack accommodating rolls 16,16'. slack control rolls 40 mounted on block 41 which remain in constant communication with rod 10. Block 41 and thus rolls 40 are arranged to move laterally along guides 43 as rod 10 deflects in creating the slack, and thus the lateral position of rolls 40 is a measure of the displacement of rod 10 relative to its centered location shown in solid. The extreme positions of rod 10 are shown by dotted lines. A transducer (not shown) coupled to block 41 signals the position of rolls 40, and this signal is used to vary the speed of the rolling mill rolls 19. The speed of rolls 19 is adjusted to match the net casting withdrawal speed multiplied by a reduction constant, thereby bounding the extent of lateral deflection of rod 10.

Figure 2:
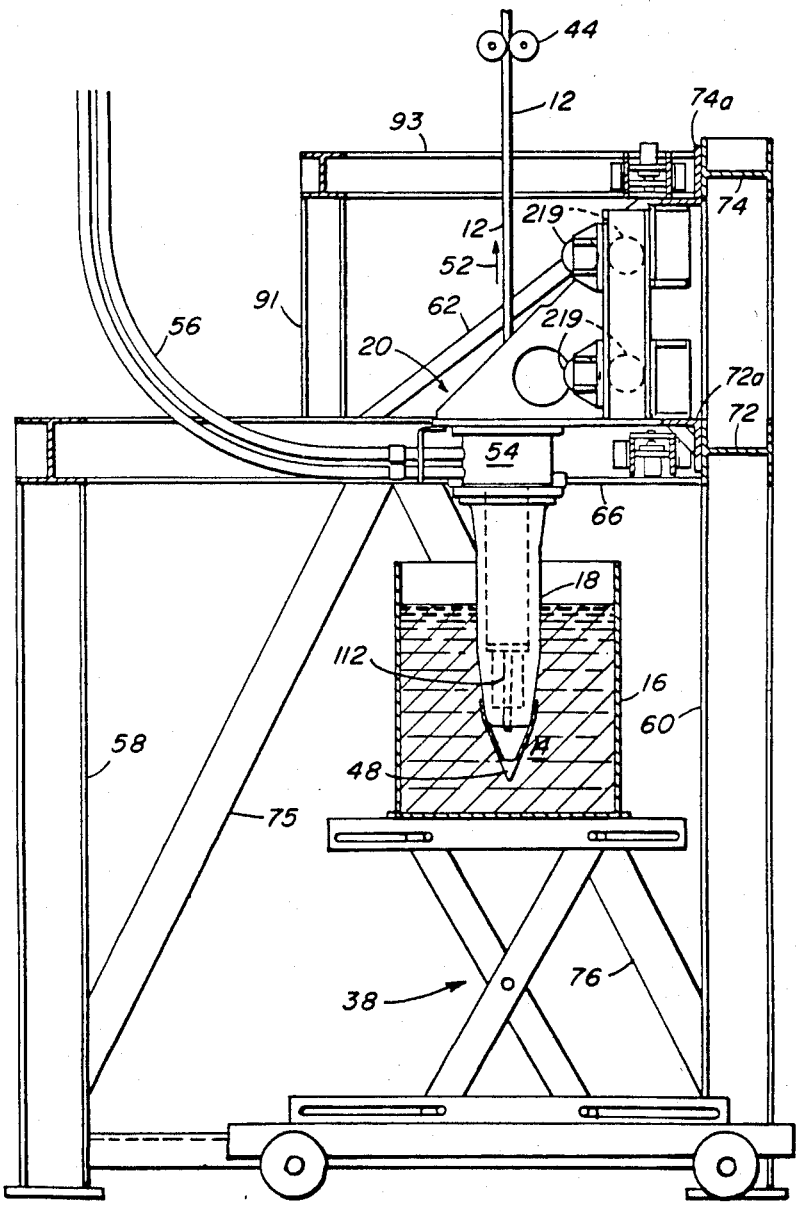
FIG. 2 is a side view partially in section of an oscillating mold assembly and support structure for use in the embodiment of FIG. 1.

Referring now to FIG. 2, a mold assembly 18 is immersed in a melt 14 contained by a furnace 16. FIG. 2 shows a protective cone 48 which melts away after the assembly 18 is immersed in the melt 14. The protective cone 48 is normally formed of copper and takes less than one minute to completely dissolve. The purpose of the protective cone is to prevent dross and other impurities from entering a die 112 upon immersion. Once the assembly is immersed in the melt and the cone has disintegrated, molten metal is drawn through the assembly 18. Initially, the process is started by inserting a solid starter rod (with a bolt on the end of it) through the die 112 from the upper part of the assembly into the melt. Molten metal solidifies on the bolt and, when the rod is pulled through the die 112, the molten metal follows, solidifying on its way. After a solidified rod or strand 12 has been threaded through the rolls 44, the starter rod (with a small piece of the strand 12) is severed from the remainder of the strand 12. Once the strand 12 has been formed from the melt 14, it is continuously withdrawn at a constant speed by one or more pairs of the pinch rollers 44. Thus, the strand 12 continuously advances away from the melt at a constant velocity, generally in the range of from 200 to 400 inches per minute in the direction shown by an arrow 52. While the strand 12 is advancing, the entire assembly 18 oscillates in the verical direction. Basically, the assembly 18 is connected to a carriage assembly 20 for controlled oscillation.

As the chilled mold assembly 18 oscillates, it is cooled by means of coolant supplied to a manifold 54 mounted to the carriage assembly 20 through flexible tubes 56. The coolant delivery system is specifically described in conjunction with FIGS. 3 and 4.

Figure 3:
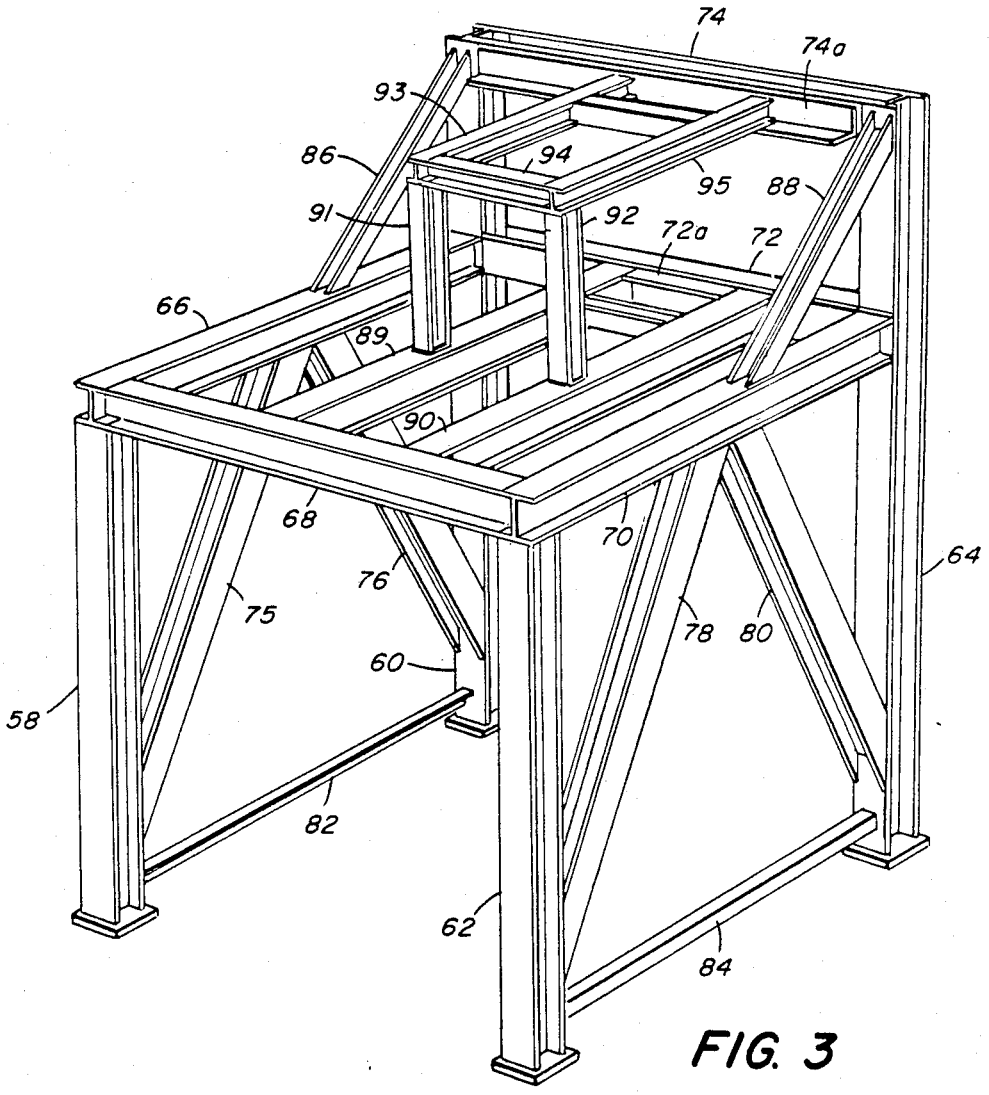
FIG. 3 is a perspective view of the support structure for the oscillating mold.

Because the mold assembly 18 oscillates during the casting process, high dynamic loads develop which must be accommodated by the supporting structure. A superstructure which resists these loads with a minimum of deflection will now be described in detail in conjunction with FIGS. 2 and 3. Referring first to FIG. 3, an overall supporting superstructure is a rigid steel box. The vertical loads are supported by the columnar structural members 58, 60, 62, 64 which are steel I-beams. The columnar members 58, 60, 62, 64 are tied together by the horizontal steel I-beams 66, 68, 70, 72 and 74. The horizontal members 66, 68, 70, 72 and 74 are preferably welded to the columnar members 58, 60, 62 and 64. The horizontal I-beams 66, 68 and 70 are oriented so that their flange faces extend in the vertical direction for maximum stiffness in carrying the oscillation induced loads. The beams 72 and 74 are further stiffened respectively by angle pieces 72*a* and 74*a* welded to the beams. The beams 66 and 70 are stiffened in the vertical direction by the bracing beams 75, 76, 78 and 80 which are also made of steel. Steel beams 82 and 84 further strengthen the structure at its bottom.

The carriage structure is mounted to angle pieces 72*a* and 74*a* which totally support the carriage through horizontal I-beams 72 and 74. Carriage load paths are fed to the frame base though beams 86, 88, 78,80,75 and 76. The steel I-beams 89 and 90 are welded between the horizontal beams 68 and 72. These beams 89 and 90 support the oscillating carriage supporting superstructure comprising vertical I-beams 91 and 92 and horizontal I-beams 93, 94 and 95. The beams 93 and 95 are welded to the steel I-beam 74 which connects the columnar beams 60 and 64 at their tops. The structure is rendered more rigid by bracing steel I-beams 86 and 88.

Figure 13:
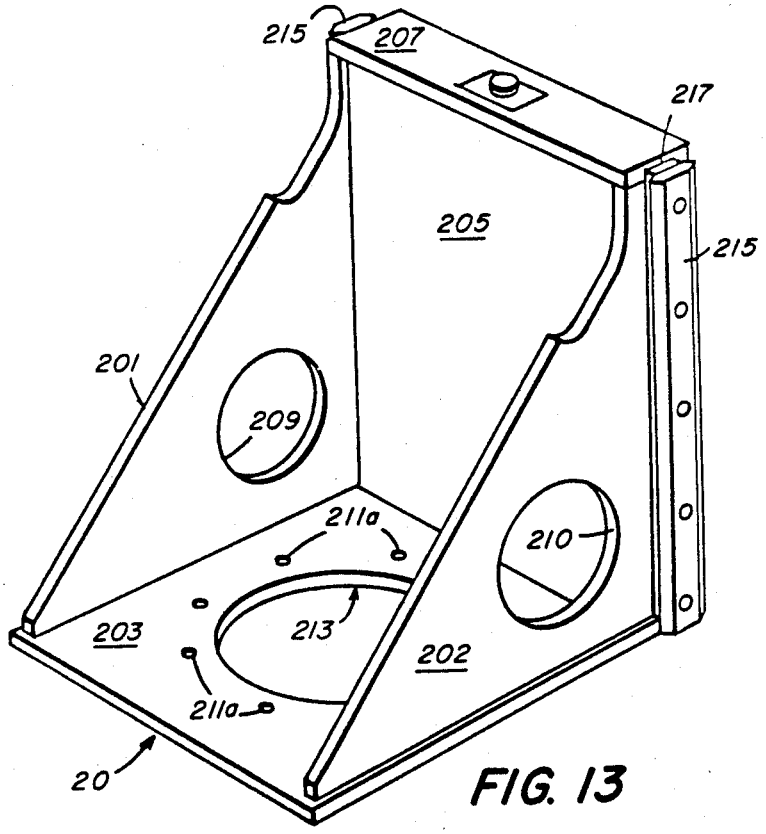
FIG. 13 is a perspective view of the carriage which supports a mold for oscillation.

The carriage assembly 20 (FIG. 2) is shown in greater detail in FIG. 13. This assembly 20 is constructed of steel angle plates 201 and 202 welded to bottom plate 203 and back plate 205. A top plate 207 is welded to the back plate 205 and the angle plates 201 and 202 to complete the structure. The plates 201 and 202, approximately one inch thick, are lightened by means of holes 209 and 210 respectively.

The carriage assembly 20 supports the manifold 54 (FIG. 2) by means of bolts through the bolt holes 211*a* (FIG. 13) which encircle a hole 213 in the bottom plate 203. The hole 213 allows the cast strand to pass through on its way to the pinch rollers 44 (FIG. 2).

Figure 14:
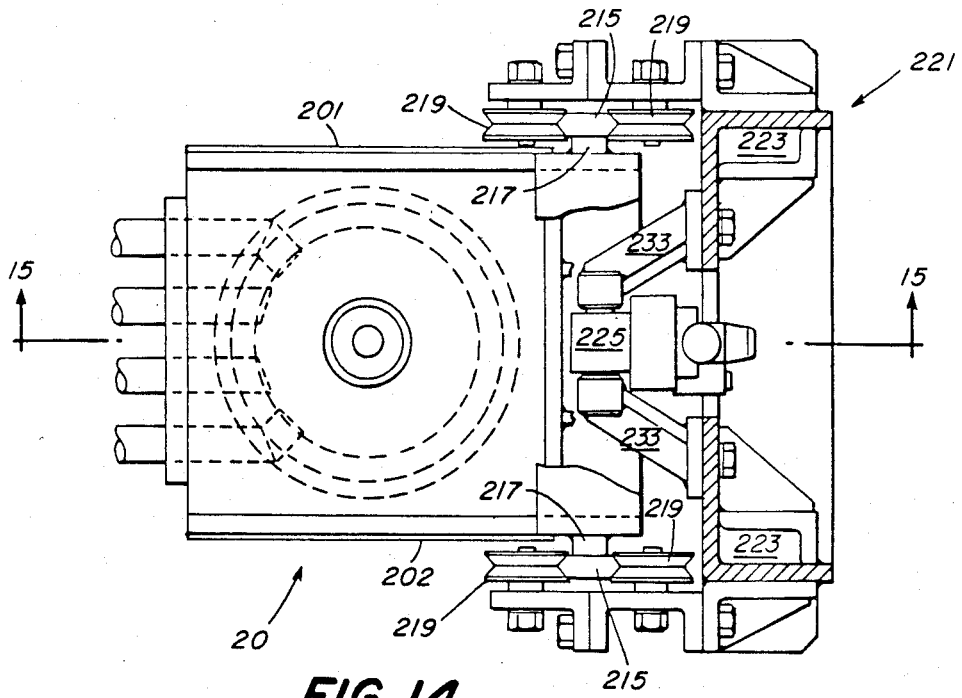
FIG. 14 is an isolated plan view of the carriage assembly of the structure of FIG. 2 for supporting and moving the oscillating mold.

Referring now to FIGS. 13 and 14, the carriage assembly 20 is constrained to move in the vertical direction by rails 215. These rails 215 are spaced apart from the angle plates 201 and 202 by means of spacers 217. The rails 215 and spacers 217 are bolted and doweled to the angle plates 201 and 202.

The rails 215 have bevelled edges which closely engage bevelled idler rollers 219 (FIG. 14). The rollers 219 are bolted to structural assembly 221. The structural assembly 221 includes welded box structures 223 for added rigidity. The structural assembly 221 is bolted rigidly to the superstructure described above in reference to FIG. 3.

Figure 15:
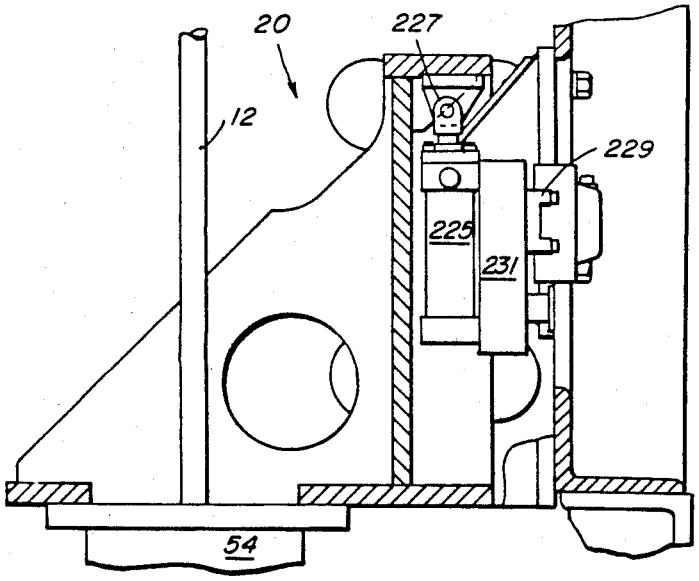
FIG. 15 is a side elevational view, in section, of the carriage assembly of FIG. 14.

With reference to FIGS. 14 and 15, the carriage assembly 20 is supported for oscillation in the vertical direction by hydraulic cylinder 225. The piston within the hydraulic cylinder 225 attaches to the top plate of carriage assembly 20 by means of bracket 227. The hydraulic cylinder 225 is controlled by servo valve 229 through manifold block 231.

The hydraulic cylinder 225 itself is supported by arms 233 (FIG. 14) which are bolted to the structural assembly 221. The servo valve 229 is under the control of a computer (not shown) which commands the desired relative motion between strand and mold for proper solidification of the cast strand. In particular, mold oscillation will create the same effect with respect to the rod or strand 12 as a pattern of forward and reverse strokes of the rod or strand itself.

Figure 9:
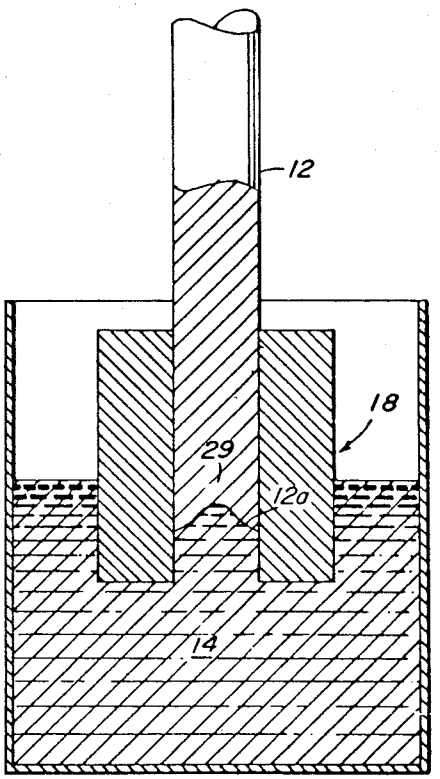
FIGS. 7–9 are diagrammatic representations of the position of the mold in a melt during various stages of mold oscillation.
Figure 8:
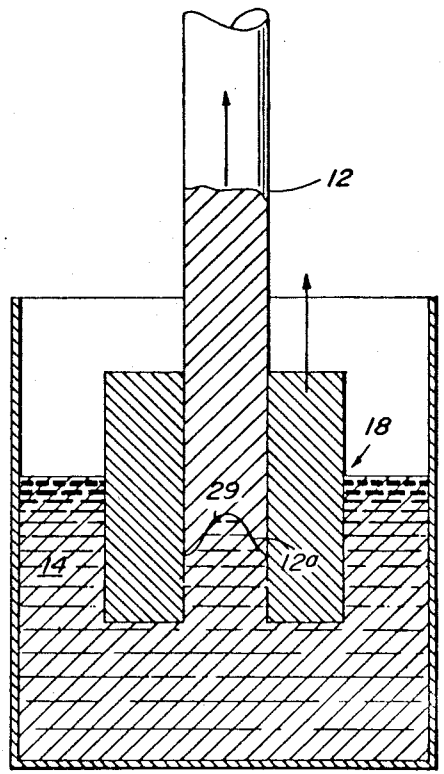
Figure 7:
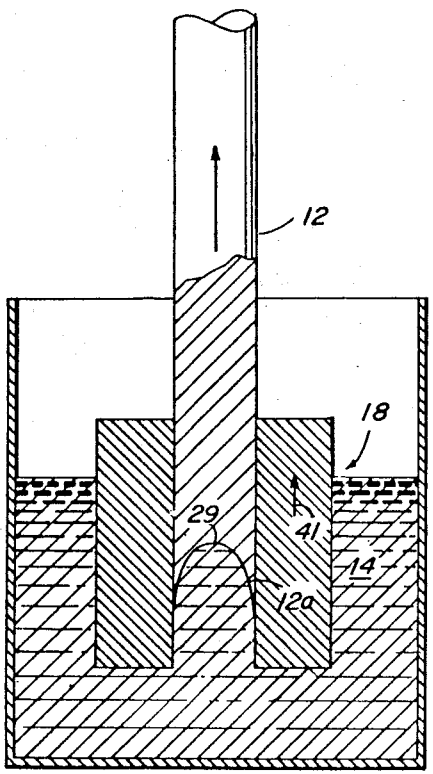

FIGS. 7–9 are provided to show the effect of mold oscillation on casting skin formation and to provide reference for the terms "forward" and "reverse" strokes. FIG. 7 shows the mold assembly 18 at its lowest point in the melt 14. At this instant in time, the mold assembly would be just beginning its acceleration in the upward direction as is indicated by the small arrow 41. At this time, the upward velocity of the strand would be greater than the upward or forward velocity of the mold. It should be noted that the solidification skin 12*a* or strand 12 is very thin. FIG. 8 shows the mold assembly 10 at about the middle of its travels up and down the melt. By the time the mold assembly has reached midpoint, its upward velocity is greater than the upward velocity of the strand. This is due to an acceleration of the mold assembly in the upward direction which is about 2 g for most applications. It is again emphasized that the velocity of the strand is constant, and only the velocity of the mold assembly varies. In FIG. 8 a solidification front 29 has moved near the top of the melt. Skin 12*a* is thicker as opposed to the skin shown in FIG. 7.

FIG. 9 shows the mold at the top of its path of travel. At the particular instant depicted in FIG. 9, the mold velocity in the upward or forward direction is zero and is about to begin its trip back down to the position shown in FIG. 7. At this position, the solidification skin 12*a* is thickest. Forward and reverse speeds are separately settable in the computer to obtain optimum surface quality and material structure. In view of FIGS. 7–9 it should be apparent that the term "forward stroke" refers to the movement of the mold assembly away from the melt while the term "reverse stroke" refers to the movement of the mold assembly further into the melt.

Figure 4:
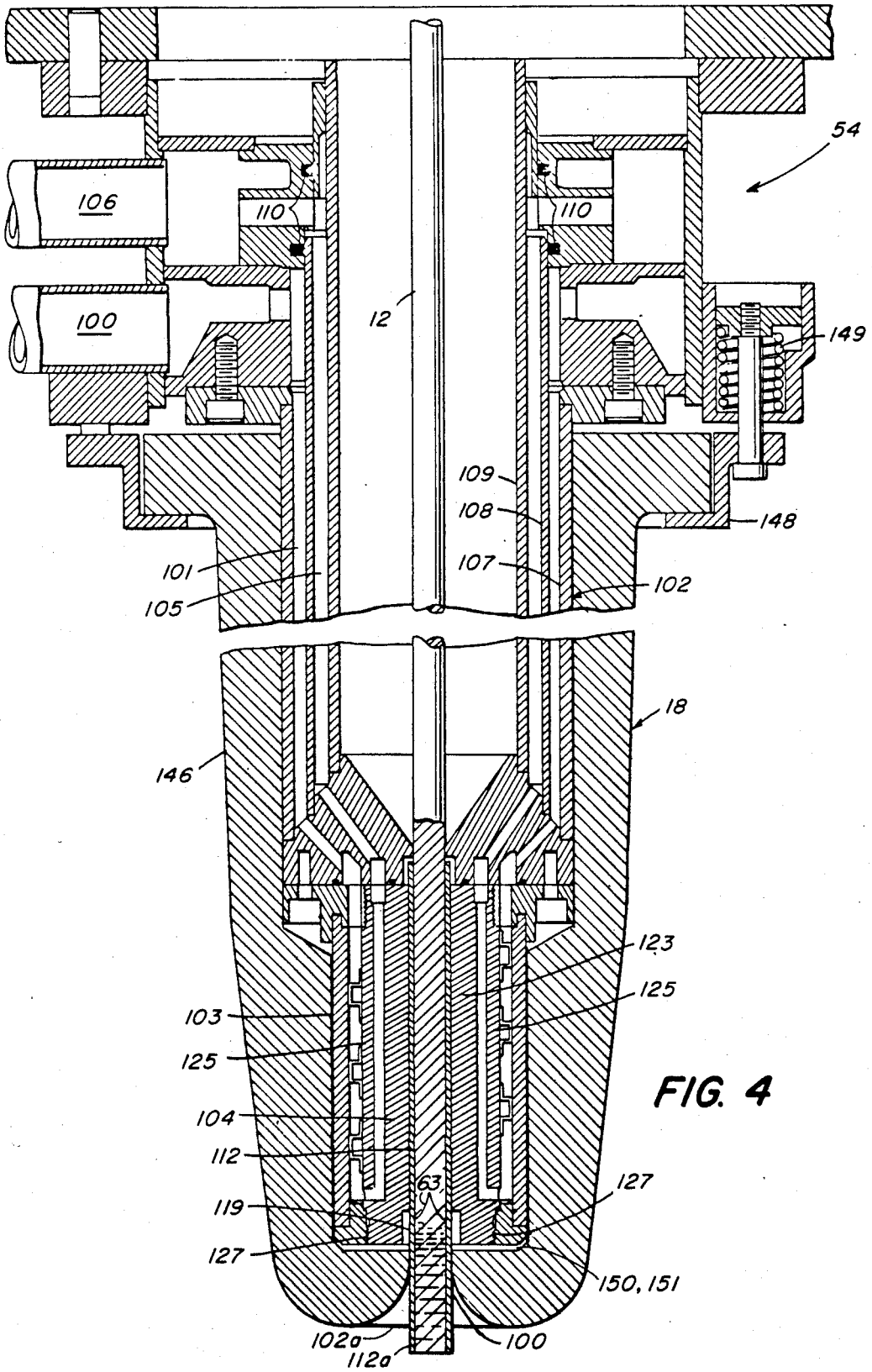
FIG. 4 is an isolated sectional view of the support manifold extension assembly and mold of the structure of FIG. 2.
Figure 5:
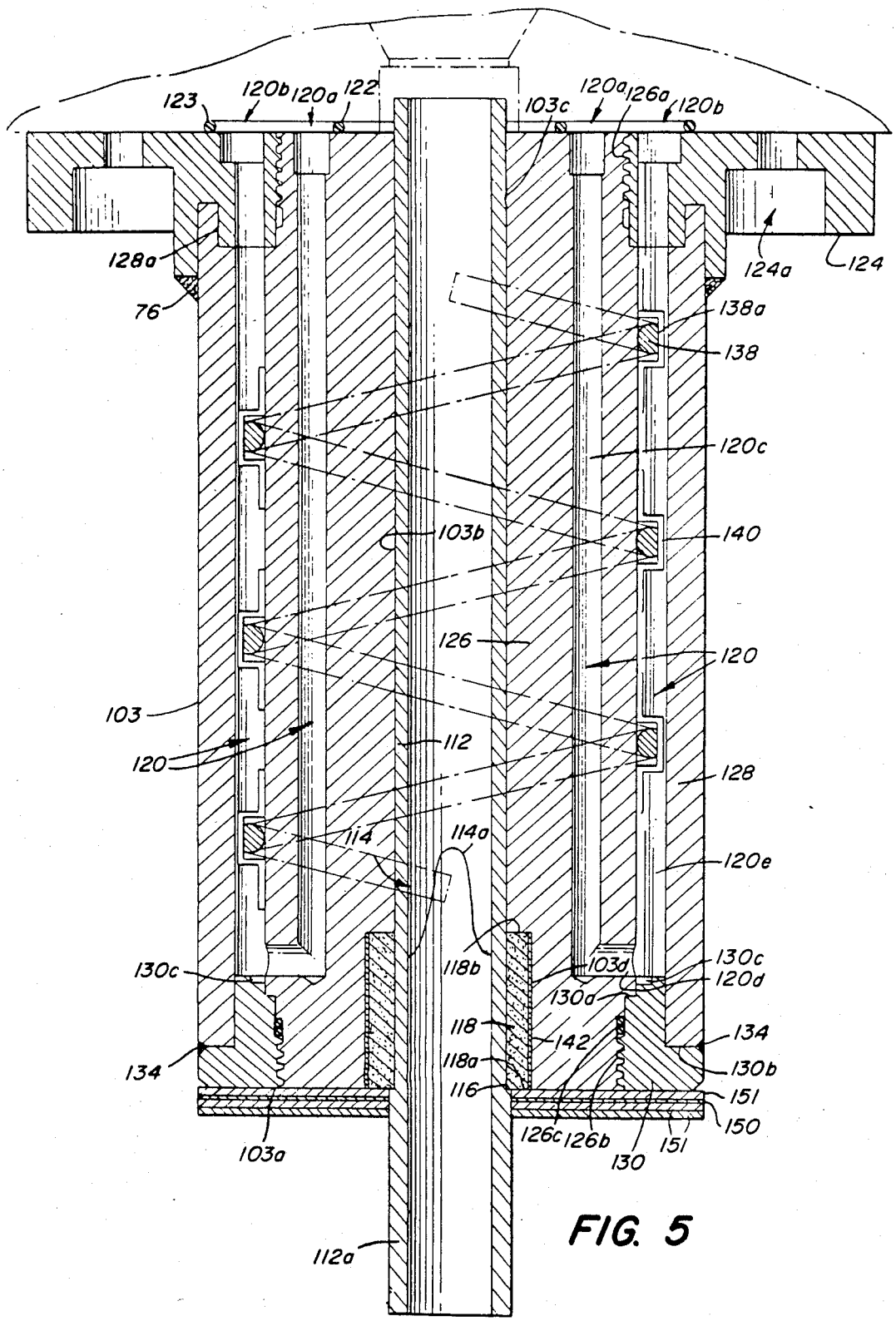
FIG. 5 is an enlarged view of the coolerbody and mold of the structure of FIG. 4.

FIGS. 4 and 5 show a preferred embodiment of the mold assembly 18 and illustrate how coolant is supplied continuously thereto. Coolant, preferably water, enters the manifold 54 at an inlet 100 and travels down an annular passageway 101 in a manifold extension assembly 102 and continues into a coolerbody 103 to cool a mold 104. The coolant returns through an annular passageway 105 and out an outlet 106. The passageways 101 and 105 are the annular spaces created by three concentric tubes 107, 108 and 109, each formed of steel. The outer tube 107 is flange mounted to the manifold 54. The two inner tubes 108 and 109 slide into O-ring gland seals 110 in manifold 54. By this arrangement, dimensional changes caused by thermal gradients are accommodated.

The concentric tube design for the manifold extension assembly 102 permits high coolant flow rates while minimizing the cross sectional area of the assembly which must oscillate within the furnace melt. Minimizing the cross sectional area is important in holding down the hydrodynamic loading on the oscillating mold assembly.

Referring now to the great detail of FIG. 5, a tubular die 112 is enclosed by the coolerbody 103. The die 112 has a lower end portion 112*a* that projects beyond the lower face 103*a* of the coolerbody. The die portion 112*a* and at least a portion of the coolerbody are immersed in the melt 14 during casting. Cuprostatic pressure forces liquid melt into the die toward the coolerbody. On start up, a length of straight rod is inserted into the die through a graphite plug and positioned with its lower end, which typically holds a bolt, somewhat above a normal solidification or casting zone 114. The immersion depth is selected so that the liquid melt reaches the casting zone 114 where rapid heat transfer from the melt to the coolerbody solidifies the melt to form a solid casting without running past the starter rod. The melt adjacent the die will cool more quickly than the centrally located melt so that an annular "skin" forms around a liquid core. The liquid solid interface defines a solidification front 114*a* across the casting zone 114. It is preferred that the peak of solidification front 114*a* be always located beneath the surface of melt 14. Since solidification initiates within the area of die 112 backed by insulating bushing 118, the location of the solidification front is well defined. A principal feature of this invention is that the casting zone is characterized by a high cooling rate and a steep vertical temperature gradient at its lower end so that it extends over a relatively short length of the die 112. These features are a result of initiating solidification of the melt within the area of the die back by the insulating member or bushing 118.

It should be noted that while this invention is described with respect to a preferred upward casting direction, it can also be used for horizontal and downward casting. Therefore, it will be understood that the term "lower" means proximate the melt and the term "upper" means distal from the melt. In down-casting, for example, the "lower" end of the mold assembly wil in fact, be above the "upper" end.

The die 112 is formed of a refractory material that is substantially non-reactive with metallic and other vapors present in the casting environment especially at temperatures in excess of 2000° F. Graphite is the usual die material, although good results have also been obtained with boron nitride. More specifically, a graphite sold by the Poco Graphite Company under the trade designation DFP-3 has been found to exhibit unusually good thermal characteristics and durability. Regardless of the choice of material for the die, before installation it is preferably outgassed in a vacuum furnace to remove volatiles that can react with the melt to cause start-up failure or produce surface defects on the casting. The vacuum environment also prevents oxidation of the graphite at the high outgassing temperatures, e.g. 750° F. for 90 minutes in a roughing pump vacuum. It will be understood by those skilled in the art that the other components of the mold assembly must also be freed of volatiles, especially water prior to use. Components formed of Fiberfrax refractory material (the trade designation of the Carborundum Co. for alumina silica refractory paper material) are pretreated by heating to about 1500° F.; other components such as those formed of silica are typically heated to 350° F. to 400° F.

The die 112 has a generally tubular configuration with a uniform inner bore diameter and a substantially uniform wall thickness. The inner surface of the die is highly smooth to present a low frictional resistance to the axial or longitudinal movement of the casting through the die and to reduce wear. The outer surface of the die, also smooth, is pressure contacted with the surrounding inner surface 103*b* of the coolerbody 103 during operation. The surface 103*b* constrains the die as it attempts to expand radially due to heating by the melt and the casting, and promotes a highly efficient heat transfer from the die to the coolerbody by the resulting pressure contact.

The fit between the die and the coolerbody is important since a poor fit, one leaving gaps, severely limits heat transfer from the die to the coolerbody. A tight fit is also important to restrain longitudinal movement of the die with respect to the coolerbody due to friction or "drag" between the casting and the die as the casting is drawn through the die. On the other hand, the die should be quickly and conveniently removable from the coolerbody when it becomes damaged or worn. It has been found that all of these objectives are achieved by machining the mating surfaces of the die and coolerbody to close tolerances that permit a "slip fit" that is, an axial sliding insertion and removal of the die. The dimensions forming the die and mating surface 103*b* are selected so that the thermal expansion of the die during casting creates a tight fit. While the die material typically has a much lower thermal expansion coefficient ($5\times10^{-6}$ in./in./° F.) than the coolerbody, ($10\times10^{-6}$ in./in./° F.) the die is much hotter than the coolerbody so that the temperature difference more than compensates for the differences in the thermal expansion coefficients. The average temperature of the die in the casting zone through its thickness is believed to be approximately 1000° F. for a melt at 2000° F. The coolerbody is near the temperature of the coolant, usually 80° to 100° F., circulating through it.

Mechanical restraint is used to hold the die in the coolerbody during low speed operation or set-up prior to it being thermally expanded by the melt. A straightforward restraining member such as a screw or retainer plate has proven impractical because the member is cooled by the coolerbody and therefore condenses and collects metallic vapors. This metal deposit can create surface defects in the casting and/or weld the restraining member in place, which generally impedes replacement of the die. Zinc vapor present in the casting of brass is particularly troublesome. An acceptable solution is to create a small upset or irregularity 103*c* on the inner surface 103*b* of the coolerbody, for example, by raising a burr with a nail set. A small step 116 formed on the outer surface of the die which engages the lower face 103*a* of the coolerbody (or more specifically, an "outside" insulating bushing or ring 118 seated in counterbore 103*d* formed in the lower end of the coolerbody) indexes the die for set-up and provides additional upward constraint against any irregular high forces that may occur such as during start-up. It should also be noted that the one-piece construction of the die elimina tes joints, particularly joints between different materials, which can collect condensed vapors or promote their passage to other surfaces. Also, a one-piece die is more readily replaced and restrained than a multi-section die.

Alternative arrangements for establishing a suitable tight-fitting relationship between the die and coolerbody include conventional press or thermal fits. In a press fit, a molybdenum sulfide lubricant is used on the outside surface to reduce the likelihood of fracturing the die during press fitting. The lubricant also fills machining scratches of the die. In the thermal fit, the coolerbody is expanded by heating, the die is inserted and the close fit is established as the assembly cools. Both the press fit and the thermal fit, however, require that the entire mold assembly 18 be removed from the cooling water manifold to carry out the replacement of a die. This is clearly more time consuming, inconvenient and costly than the slip fit.

While the preferred form of the invention utilizes a one-piece die with a uniform bore diameter, it is also possible to use a die with a tapered or stepped inner surface that narrows in the upward direction, or a multi-section die formed of two or more pieces in end-abutting relationship. Upward narrowing is desirable to compensate for contraction of the casting as it cools. Close contact with the casting over the full length of the die increases the cooling efficiency of the mold assembly. Increased cooling is significant because it helps to avoid a central cavity caused by an unfed shrinkage of the molten center of the casting.

To minimize expense, an opposite taper can be machined on the outer surface of the die rather than on its inside surface, or the inside surface 103*b* of the coolerbody. Thermal expansion of the die within the coolerbody bore during casting creates the desired upwardly narrowing taper on the highly smooth inner surface of the die. Multi-section dies can either have the same bore diameter or different bore diameters to create a stepped upward narrowing. To avoid troublesome accumulations of metal between the die sections, junctions between sections should occur only above the casting zone. Also, the upper section or sections above the casting zone can be press fit since the lower section is the most likely to become damaged and need replacement.

By way of illustration, but not of limitation, a one-piece die formed of Poco type graphite, suitable for casting three-quarter inch rod, has a length of approximately ten and one half inches and a uniform wall thickness of approximately one-eighth to one-fifth inch. In general, the wall thickness will vary with the diameter of the casting. The projecting die portion 112*a* typically has a length of two inches.

Figure 6:
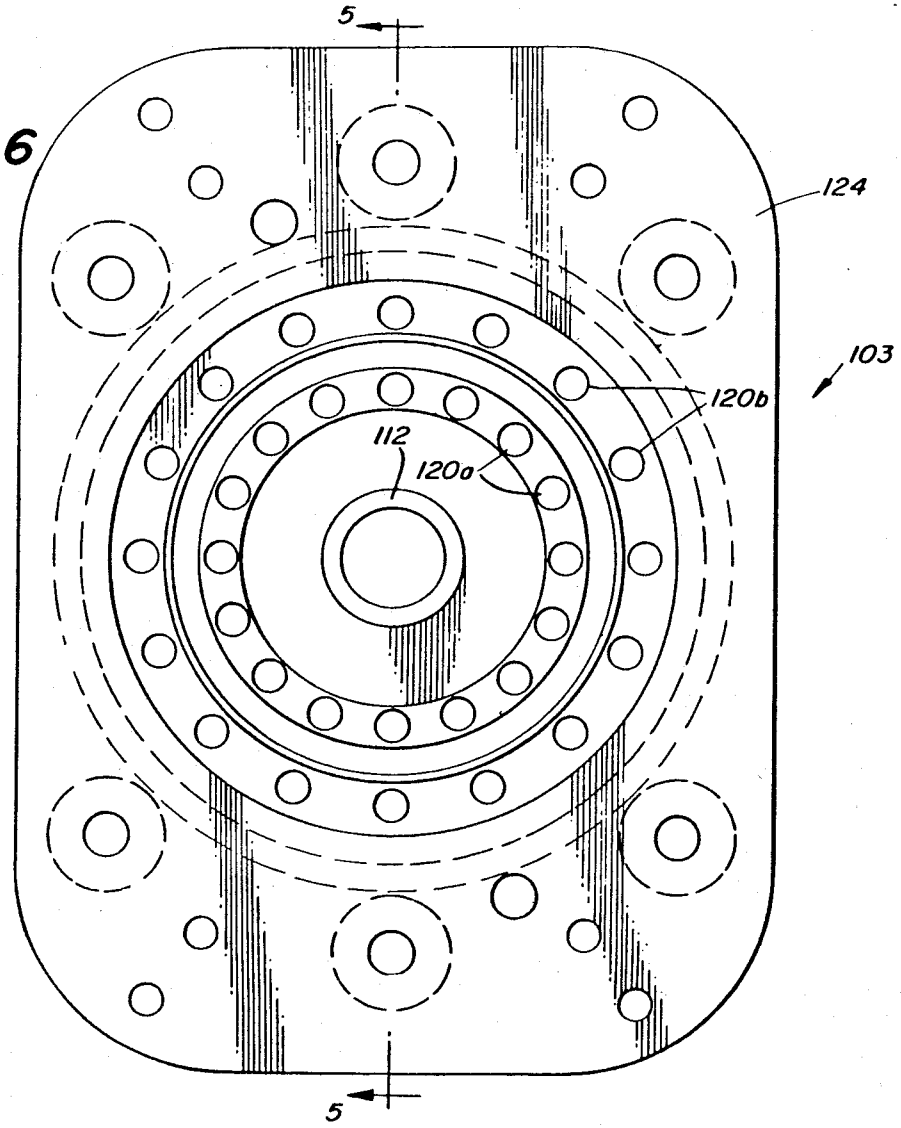
FIG. 6 is a top plan view of the coolerbody shown in FIG. 5.
Figure 10:
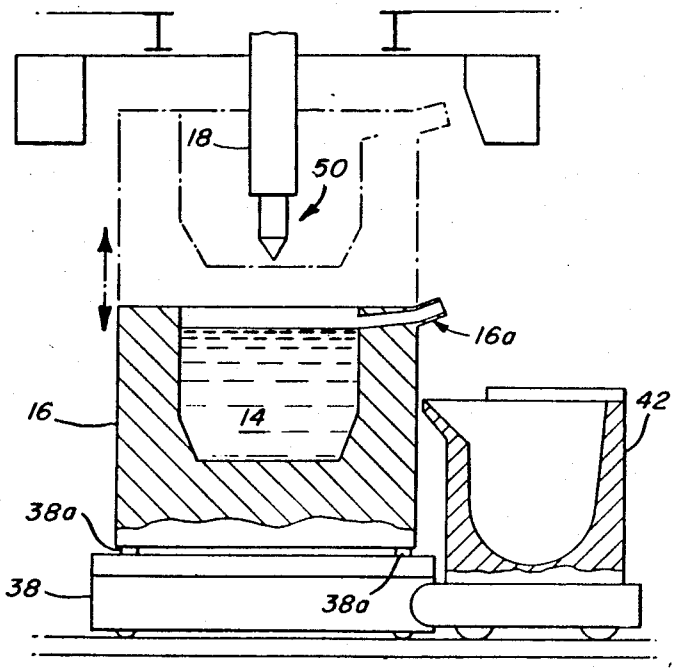
FIG. 10 is a simplified view in vertical section showing the casting furnace shown in FIG. 1 in its lower and upper limit positions with respect to the mold assemblies.

The coolerbody 103 has a generally cylindrical configuration with a central, longitudinally extending opening defined by the inner surface 103*b*. The interior of the coolerbody has a passage designated generally at 120 that circulates the cooling fluid, preferably water, through the coolerbody. A series of coolant inlet openings 120*a* and coolant outlet openings 120*b* are formed in the upper end of the coolerbody. As is best seen in FIG. 6, these openings are arrayed in concentric circles with sufficient openings to provide a high flow rate, typically one gallon per pound of casting per minute. A pair of O-rings 122 and 123, preferably formed of a long wearing fluoroelastomer, seal the manifold extension assembly 102 (see FIG. 5) in fluid communication with the inlet and outlet openings. A mounting flange 124 on the coolerbody has openings 124*a* that receives bolts (not shown) to secure the mold assembly to the manifold extension assembly. This flange also includes a hole (not shown to vent gases from the annular space between the coolerbody and an insulating hat (see FIG. 4) through a tube (not shown) in the manifold 54 to atmosphere.

The coolerbody has four main components: an inner body 126, an outer body 128, a jacket closure ring 130 and the mounting flange 124. The inner body is formed of alloy that exhibits excellent heat transfer characteristics, good dimensional stability and is hard and wear resistant. Age hardened copper such as the alloy designated CDA 182 is preferred. The outer body 128, closure ring 130 and mounting flange 124 are preferably formed of stainless steel, particularly free machining 303 stainless for the ring 130 and flange 124, and 304 stainless for the outer body 128. Stainless exhibits satisfactory resistance to mechanical abuse, possesses similar thermal expansion characteristics as chrome copper, and holds up well in the casting environment. By the use of stainless steel, very large pieces of age hardened copper are not required, thus making manufacture of the coolerbody more practical.

The inner body is machined from a single cylindrical billet of sound (crack-free) chrome copper. Besides cost and functional durability advantages, the composite coolerbody construction is dictated by the difficulty in producing a sound billet of chrome copper, which is large enough to form the entire coolerbody. Longitudinal holes 120*c* are deep drilled in the inner body to define the inlets 120*a*. The holes 120*c* extend at least to the casting zone and preferably somewhat beyond it as shown in FIG. 5. Cross holes 120*d* are drilled to the bottom of the longitudinal holes 120*c*. The upper and lower ends of the inner body are threaded at 126*a* and 126*b* to receive the mounting flange 124 and the closure ring 130, respectively, for structural strength. The closure ring has an inner upwardly facing recess 130*a* that abuts a mating step machined on the inner body for increased braze joint efficiency, to retard the flow of cooling water into the joint, and to align the ring with the inner body. An outer, upwardly facing recess 130*b* seats the lower end of the outer body 128 in a fluid-tight relationship.

Because the threaded connection at 126*b* will leak if not sealed well and is required to withstand resolutionizing and aging of softened coolerbody bores, the joint is also copper/gold brazed. While copper/gold brazing is a conventional technique, the following procedures produce a reliable bond that holds up in the casting environment. First, the mating surfaces of the closure ring and the inner body are copper plated. The plating is preferably 0.001 to 0.002 inch thick and should include the threads, the recess 130*a* and groove 130*c*. The braze material is then applied, as by wrapping a wire of the material around the inner body in a braze clearance 126*c* above the threads and in the groove 130*c* atop closure ring 130. Two turns of a one-sixteenth inch diameter wire that is sixty percent copper and forty percent gold is recommended in clearance 126*c* and three turns in groove 130*c*. A braze paste of the same alloy is then spread over the mating surfaces. The closure ring is tightly screwed onto the inner body and the assembly is placed in a furnace, brazed end down, and preferably resting on a supported sheet of alumina silica refractory paper material such as the product sold by Carborundum Co. under the trade designation Fiberfrax. The brazing temperature is measured by a thermocouple resting at the bottom of one of the longitudinal holes 120*c*. The furnace brings the assembly to a temperature just below the fusing point of the braze alloy for a short period of time such as 1760° F. to 1790° F. for ten minutes. The furnace atmosphere is protected (inert or a vacuum) to prevent oxidation. The assembly is then rapidly heated to a temperature that liquifies the braze alloy (1860° F. to 1900° F.) and is immediately allowed to cool to room temperature, again in a protected atmosphere. Solution treating of the chrome copper is best performed at a separate second step by firing the part to 1710° F. to 1750° F. for 15 minutes in a protected atmosphere and followed by liquid quenching.

Once the closure ring is joined to the inner body, the remaining assembly of the coolerbody involves TIG welding type 304 to type 303 stainless steel using type 308 rod after preheating parts to 400° F. The outer body 128, which has a generally cylindrical configuration, is welded at 134 to the closure ring. The upper end of the outer body has an inner recess 128*a* that mates with the mounting flange 124 just outside the water outlet openings 120*b*. A weld 136 secures those parts. The closure ring and mounting flange space the outer body from the inner body to define an annular water circulating passage 120*e* that extends between the cross holes 120*d* and the outlet openings 120*b*. A helical spacer 138 is secured in the passage 120*e* to establish a swirling water flow that promotes a more uniform and efficient heat transfer to the water. The spacer 138 is preferably formed of one-quarter inch copper rod. The spacer coil is filed flat at points 138*a* to allow clearance for holding clips 140 secured to the inner body. A combination aging (hardening) treatment of the chrome copper and stress relief of the welded stainless steel is accomplished at 900° for at least two hours in a protected atmosphere. The coolerbody is then machined and leak tested.

By way of illustration only, cooling water is directed through the inlets 120*a*, the holes 120*c* and 120*d*, and the spiral flow path defined by the passage 120*e* and the spacer 138 to the outlets 120*b*. The water is typically at 80° F. to 90° F. at the inlet and heats approximately ten to twenty degrees during its circulation through the coolerbody. The water typically flows at a rate of about one gallon per pound of strand solidified in the casting zone per minute. A typical flow rate is 25 gallons per minute. The proper water temperature is limited at the low end by the condensation of water vapor. On humid days, condensation can occur at 70° F. or below, but usually not above 80° F. Water temperatures in excess of 120° F. are usually not preferred. It should be noted that the inlet and outlet holes can be reversed; that is, the water can be applied to the outer ring of holes 120*b* and withdrawn from the inner ring of holes 120*a* with no significant reduction in the cooling performance of the coolerbody. The spacing between the die and the inner set of holes is, however, a factor that affects the heat transfer efficiency from the casting to the water. For a three-quarter inch strand 12, the spacing is typically approximately $\frac{5}{8}$ inch. This allows the inner body 126 to be rebored to cast a one inch diameter strand and accept a suitably dimensional outside insulator 118. In general, the aforedescribed mold assembly provides a cooling rate that is high compared to conventional water jacket coolers for chilled mold casting in closed systems.

Another important factor of this invention is the outside insulating bushing 118 which ensures that the die is dimensionally uniform in the casting zone and prevents an excessive outward expansion of the die below the zone (bell-mouthing) that can lead to termination, start up defects, or surface defects. The bushing 118 is also important in creating a steep axial die temperature gradient immediately below the casting zone. For example, without the bushing 118, a sharp temperature gradient would exist at the entrance of the die into the coolerbody causing the lower portion 112*a* of the die to form a bell-mouth casting skin. The enlarged portion cannot be drawn into the coolerbody past the casting zone. It wedges, breaks off from the casting, and can remain in place as casting continues. This wedged portion can result in poor surface quality or termination of the strand. The bushing 118 prevents this problem by mechanically restraining the outward expansion of the die immediately below the casting zone 114. It also insulates the die to a great extent from the coolerbody to create a gentle thermal gradient in the die over the region extending from the lower coolerbody face 103*a* to somewhat below the lower edge of the casting zone 114.

The bushing 118 is formed of a refractory material that has a relatively low coefficient of thermal expansion, a relatively low porosity, and good thermal shock resistance. The low coefficient of thermal expansion limits the outward radial pressures exerted by the bushing on the coolerbody and, with the coolerbody, constrains the graphite to maintain a substantially uniform die inner diameter. The low coefficient of thermal expansion also allows the bushing 118 to be easily removed from the coolerbody by uniformly heating the assembly to 250° F. A suitable material for the bushing 118 is cast silica glass ($SiO_2$) which is machinable.

The bushing 118 extends vertically from a lower end surface 118*a* that is flush with the lower coolerbody face 103*a* to an upper end surface 118*b* somewhat above the lower edge of the casting zone. In the production of three-quarter inch brass rod, a bushing having a wall thickness of approximately one-quarter inch and a length of one and three-eighth inches has yielded satisfactory results.

In practice, it has been found that metallic vapors penetrate between the inside insulating bushing 118 and the coolerbody counterbore 103*d*, condense and bond the ring to the coolerbody making it difficult to remove. A thin foil shim 142 of steel placed between the ring and the counterbore solves this problem. The bushing and the shim are held in the counterbore by a special thermal fit, that is, one which allows easy assembly and removal when the bushing and the coolerbody are heated to 400° F.

Figure 11:
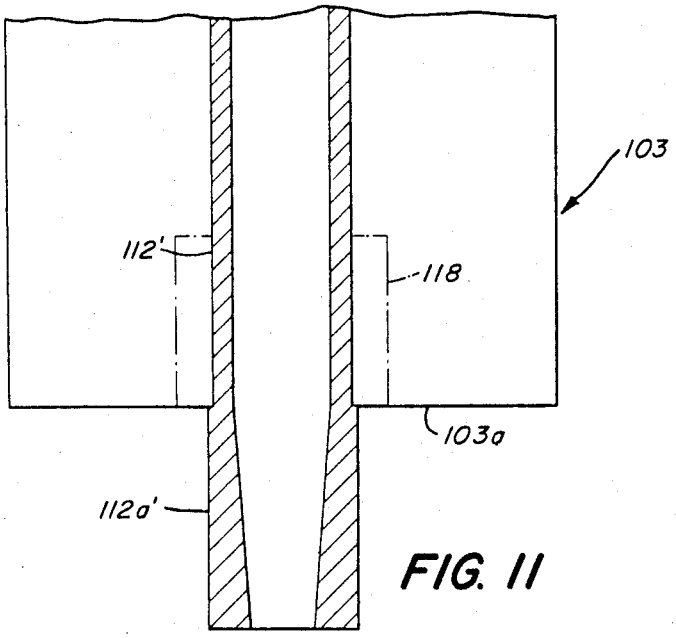
FIGS. 11 and 12 are simplified views in vertical section of alternative arrangements for controlling the expansion of the die below the casting zone.
Figure 12:
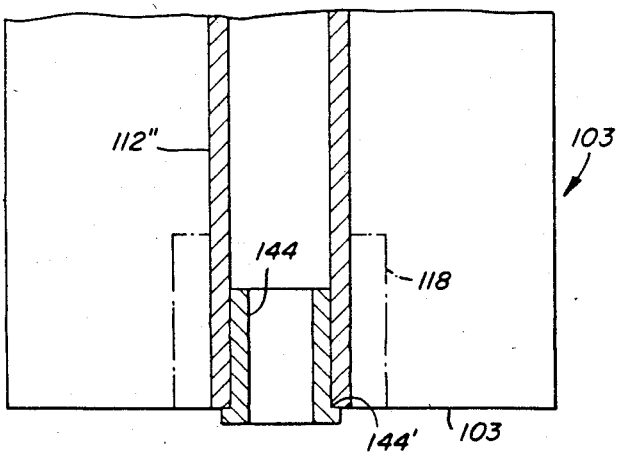

FIGS. 11 and 12 illustrate alternative arrangements for ensuring that the casting occurs in a dimensionally uniform portion of the die and for controlling the expansion of the die below the casting zone. FIG. 11 shows a die 112' which is identical to the die 112, except that the projecting lower portion 112*a* has an upwardly expanding taper formed on its inner surface. The degree of taper is selected to produce a generally uniform diameter bore when the die portion expands in the melt.

This solution, however, is difficult to fabricate. Also, in practice, it is nevertheless necessary to use the bushing 118 (shown in phantom) as well as the die 112' to achieve the high production speeds and good casting quality characteristics of this invention.

FIG. 12 shows an "inside" insulator 144 that slips inside a die 112 which is the same as the die 112 except that it is terminated flush with the coolerbody face 103*a*. The inside insulator 144 is formed of refractory material that does not react with the molten metal and has a relatively low thermal expansion so that it does not deform the coolerbody. The lower end of the insulator 144 extends slightly beyond the lower end of the die 112" and the coolerbody while it has an enlarged outer diameter to form a step 144' similar in function to the step 116 on the die 112. The upper end should be placed near the lower end of the casting zone, usually ½ inch below the upper edge of the bushing 118. If the upper end extends too high, relative to the outside insulator, the strand will cast against the insulator leaving indentations in the strand. The bore dimensions of the inside insulator are also significant, particularly on startup, during a hold, or during a slow down, because the melt begins to solidify on the inside insulator 144. To prevent termination, the inner surface of the insulator 144 must be smooth and tapered to widen upwardly. As with the die 112', the outside insulator or bushing 118 is used in conjunction with the inside insulator 144 to reduce the aforementioned difficulties.

Referring again to FIG. 4, a ceramic hat 146 surrounds the coolerbody 103 and the manifold extension assembly 102 to insulate them thermally from the metallic melt, so that the coolerbody may perform its function of cooling the mold so that rod solidification may occur. The hat 146 is formed from any suitable refractory material such as cast silica. The hat 146 attaches to the manifold 54 by means of a ring 148 which is spring biased against the manifold 54 by a spring 149. By this means of attachment, the hat 146 is pulled tightly against the coolerbody 103 while allowing for dimensional changes from differential thermal expansion. The spring 149 is preloaded to create a total force greater than the highest G loading to be experienced during oscillation, thereby maintaining a tight seal between the hat 146 and the coolerbody 103. The hat allows the mold assembly to be immersed in the melt to any preselected depth. While immersion to a level below the casting zone is functional, the extremely high production speed characteristics are, in part, a result of a relatively deep immersion, at least to the level of the casting zone. One advantage of this deep immersion is to facilitate feeding the melt to the liquid core of the casting in the casting zone.

A vapor shield 150 and gaskets 151 (see also FIG. 5) are placed in the gap between the hat and the coolerbody adjacent the die to prevent the melt and vapors from entering the gap and to further thermally insulate the coolerbody. The gaskets are preferably three or four annular layers of "donuts" of the aforementioned Fiberfrax refractory fiber material, while the vapor shield is preferably a "donut" of molybdenum foil interposed between the gaskets 151. The shield 150 and gaskets 151 extend from the die extension 112*a* to the outer diameter of the coolerbody. The combined thickness of these layers is sufficient to firmly engage the coolerbody face 103*a* and the end face of the hat 146 typically one-quarter inch.

In a typical cycle of operation, the casting furnace 16 is filled with a molten alloy. A rigid, stainless steel rod is used to start up the casting. A steel bolt is screwed into the lower end of the rod. The rod has the dimensions of the strand to be cast, e.g. three quarter inch diameter rod, so that the rod can be fed down through the mold assembly and can be engaged by the withdrawal machine 22.

Whenever the mold assembly is inserted into the melt, a cone of a material non-contaminating to the melt being cast, preferably solid graphite, covers the die portion 112*a* (or a refractory die extension such as the inside insulator 144). An additional alloy cone 48 of a material non-contaminating to the melt, typically copper, covers the lower end of the hat 146. The cones pierce the cover and dross on the surface of the melt to reduce the quantity of foreign particles caught under the coolerbody and in the die. The melt dissolves the cone 48 and the starter rod bolt pushes the smaller graphite cone off the die and it floats to the side. An advantage of the preferred form of this invention, utilizing a projecting die portion 112*a*, is that it supports and locates the smaller graphite cone on insertion into the melt. To function properly, the surface of the larger cone 48 should form an angle of forty-five degrees or less with the vertical.

After the graphite cone has been displaced, the bolt extends into the melt and the melt solidifies on the bolt. During start up and after the strands have advanced sufficiently above the drive wheels 44, the cast rod is sheared below the steel bolt and the strands are mechanically diverted onto the booms 24, 24'. Before replacing the starter rods in a storage rack for reuse, the short length of casting and the steel bolt is removed. An alternative starter rod design uses a short length of rigid stainless steel rod attached to a flexible cable which can be fed directly onto the boom 24 because of its flexibility. The withdrawal machine is then ramped up to a speed to begin the casting. Between shifts or during temporary interruptions, such as for replacement of a coiler, the strand is stopped and clamped. Casting is resumed simply by unclamping and ramping up to full speed.

As the strand 12 is withdrawn, forward strokes pull the solidified casting formed in the casting or solidification zone upwardly to expose melt to the cooled die, which quickly forms a skin on this newly exposed die surface. During steady state operation, the rod is pulled at a constant rate in the range from 200 to 400 inches per minute. Simultaneously, the entire mold assembly, including the enclosed die 112, is oscillates vertically with an acceleration of about 1 g, reaching a top speed of about four inches per second in each direction. The oscillation allows the new skin to strengthen and attach to the previously formed casting. Because of the high cooling rate of the coolerbody and the steep temperature gradient generated by the outside insulator 118, the solidification occurs very rapidly over a relatively short length of the die. As stated earlier, typical melt temperatures for oxygen free copper and copper alloys are 1900° F. to 2300° F. In practicing the present invention, the insulator (bushing 118) insulate the melt from the coolerbody to maintain the melt as a liquid within the die below the casting zone. Near the upper edge of the insulator the melt temperature drops rapidly and solidification begins. In casting three quarter inch brass rod at over 100 ipm, the casting zone extends longitudinally for 1 to 1½ inches. At the top of the casting zone, the strand is solid. Estimated average temperature of brass castings in the solidification zone are 1650° F. to 1750° F. A typical temperature for the brass casting as it leaves the mold assembly is 1500° F. At the upper end of the mold assembly, there is a clearance around the strand to ensure the presence of oxygen or a water saturated atmosphere to burn off zinc vapors before they condense and flow down to the casting zone. The strand, thus produced, is of exceptionally good quality. The strand is characterized by a fine grain size and dendrite structure, good tensile strength and good ductility.

There has been described a simple, low cost oscillating mold assembly and a withdrawal process for use with the mold assembly that are capable of continuously producing high quality metallic strands, particularly brass, at extraordinarily high speeds. In particular, the mold assembly and withdrawal process provide sophisticated solutions to the many serious difficulties attendant the casting environment such as extreme temperatures and temperature differentials, metallic and water vapors, foreign particles present in the casting furnace and differentials in the thermal expansion coefficients of the materials forming the mold assembly.

The invention is further illustrated by the following nonrestrictive example. Referring to FIG. 1, a 4,400 pound melt 12 of free-cutting brass, CDA 360, is charged into the furnace 13 and maintained in the molten state. The composition for alloy CDA 360 is:

| | Weight Percent |
|---|---|
| Lead | 2.5–3.7 |
| Copper | 60.0–63.0 |
| Iron | 0–0.35 |
| Impurities | 0–0.5 |
| Zinc | balance |

Using an oscillating chilled mold 11 as set forth above and in the co-pending application Ser. No. 117,028, a three-quarter inch diameter rod is cast in the upward direction. Of course it should be noted that as to the continuous production of brass strip it does not matter in which direction the rod 10 is cast. Thus, the rod may be side cast, bottom cast, or up cast.

The solidified rod 10 is drawn by the rollers 14 at a speed of 200 inches per minute. At the initiation of continuous withdrawal of the rod 10, the oscillating mold 11 is immersed in the melt 12 to a depth of about 5 inches. During casting, the dunk depth of the mold 11 varies from approximately 7 inches to 3 inches immersion. During mold oscillation, the temperature of the melt 12 is maintained at 1850° F. and molten alloy is fed into the furnace 13 as needed during casting to maintain the immersion depths of the mold 11. The forward and reverse mold speed during oscillation reaches a top value of 4 inches per second due to a mOld acceleration of 1 g. The distance the mold travels between its uppermost position in the melt and the bottommost position is approximately 1.75 inches.

The temperature of the rod 10 at the withdrawal rolls 14 is about 1450° F. The withdrawal rolls 14 are about 52 inches from the top of the mold. The distance from withdrawal rolls 14 to the front door of the reheater 18 is about 91 inches. The temperature of the rod in the reheater is increased to about 1470° F. The hot mill 19 is about 23 inches from the rear door of the reheater 18. After exiting from the hot rolling mill, the rod is continuously flattened into a strip. The dimensions of the strip is 0.080 inches thick and 2.135 inches wide. It should be noted that any high torque hot rolling mill can be utilized to flatten the rod 10 into strip. The particular mill used in this embodiment has a torque of 10,000 foot-pounds and exerts a separating force of 75,000 pound.

While the invention has been described with reference to its preferred embodiments, it is to be understood that modifications and variations will occur to those skilled in the art. Such modifications and variations are intended to fall within the scope of the appended claims.

What is claimed is:

1. An apparatus for integrated, continuous manufacture of hot rolled metallic strip from a melt comprising:

(1) casting means for continuous production of metallic rod from the melt, said casting means including a mold communicating with said melt, which mold oscillates in a direction parallel to the direction of travel of said rod, (2) said casting means further comprising a driven withdrawal roll in conjunction wiht a pinch roll to draw said rod through said mold at a constant rate, (3) means cooperating with said causing means for regulating the speed of the metallic rod to maintain a substantially constant forward speed before the rod is converted to strip, said means for regulating the speed of the metallic rod comprising:

(a) means for changing the direction of travel of said rod after emergence from said drawing means, (b) means permitting slack through lateral deflection of said rod, said means permitting said slack comprising one or more pairs of slack accommodating rolls arranged near the mid-point of said arcuate path which are adapted to restrain said rod in a direction parallel to the axis of said slack accommodating rolls while allowing deflection of said rod in a direction perpendicular to the axis of said slack accommodating rolls, and (c) means for advancing said rod in a manner to control said slack, and (4) processing means cooperating with said casting means and said regulating means for continuous conversion of said rod to said hot rolled strip, said processing means comprising a rolling mill adapted for flattening said rod for conversion to strip.

(5) said casting means, means for regulating and processing means being arranged to act on a metallic rod which is continuous from said casting means through said processing means to continuously form an integrated metallic strip.

2. The apparatus of claim 1 wherein said means for changing said direction of travel of said rod comprises a plurality of guide rolls arranged on an arcuate path thereby causing said rod to follow said arcuate path.

3. The apparatus of claim 2 wherein said means for advancing said rod to control said slack comprises means for varying the speed of rolling mill rolls in response to the magnitude of said lateral deflection to match said roll speed to the casting speed of said rod multiplied by a reduction constant, thereby to maintain said lateral deflection near a fixed reference position.

4. The apparatus of claim 1 wherein said processing means further comprises:

(1) a quench chamber for quenching said strip, and (2) winding means for coiling said finished strip.

5. The apparatus of claim 2 wherein said arcuate path extends 70°–110°.

6. The apparatus of claim 2 wherein said slack accommodating rolls are disc-like and have deeply recessed grooves in their circumferential faces, said grooves accepting lateral deflections of said rod creating said slack.

7. Apparatus for integrated, continuous high speed manufacture of hot rolled metallic strip from a melt comprising:

up-casting chilled mold communicating with said melt for casting metallic rod and arranged to oscillate with respect to a fixed reference position;

one or more pairs of rolls gripping said rod and driven to draw said rod through said mold at a constant speed with respect to said fixed reference position;

means for oscillating said mold in a direction parallel to the direction of travel of said rod, in a pattern of forward and reverse strokes;

a plurality of pairs of guide rolls for guiding said rod and arranged in an arcuate path for changing the direction of travel of said rod;

one or more slack accommodating rolls arranged near the mid-point of said arcuate path and adapted to restrain said rod in a direction parallel to the axis of said slack accommodating rolls while allowing deflection of said rod in a direction perpendicular to the axis of said slack accommodating rolls thereby permitting slack through lateral deflection of said rod;

a pair of slack control rolls disposed near the mid-point of said arcuate path and in constant comnunication with said rod arranged to move laterally with said rod in response to said deflection;

a pair of variable speed driven rolls for advancing said rod, the speed of said rolls varied according to the magnitude of said deflection thereby to bound said deflection;

a reheating device for raising the temperature of said rod for hot rolling;

a hot rolling mill for converting said rod into said strip;

a quench chamber for quenching said strip; and a winding means for coiling said strip.

8. An apparatus for integrated, continuous manufacture of hot rolled metallic strip from a melt comprising:

(1) casting means for continuous production of metallic rod from the melt, said casting means comprising a casting chilled mold communicating with said melt, which mold oscillates in a direction parallel to the direction of travel of said rod in a pattern of forward and reverse strokes with respect to a fixed reference point, and including means for drawing said rod through said mold at a constant rate with respect to said fixed reference point; and (2) processing means cooperating with said casting means for continuous conversion of said rod to said hot rolled strip, said processing means comprising:

(A) means for changing the direction of travel to said rod after emergence from said drawing means, said means for changing said direction of travel of said rod comprising a plurality of guide rolls arranged on an arcuate path, thereby causing said rod to follow said arcuate path, (B) means permitting slack through lateral deflection of said rod, said means permitting said slack comprising one or more pairs of slack accommodating rolls arranged near the mid-point of said arcuate path which are adapted to restrain said rod in a direction parallel to the axis of said slack accommodating rolls while allowing deflection of said rod in a direction perpendicular to the axis of said slack accommodating rolls, (C) means for advancing said rod in the manner to control said slack, and (D) rolling-means for converting said rod to said strip.

9. The apparatus of claim 8 wherein said means for advancing said rod to control said slack comprises means for varying the speed of rolling mill rolls in response to the magnitude of said lateral deflection to match said roll speed to the forward casting speed of said rod multiplied by a reduction constant, thereby to maintain said lateral deflection near a fixed reference position.

10. The apparatus of claim 8 wherein said processing means also comprises:

(1) a hot rolling mill for converting said rod into said strip, (2) a quench chamber for quenching said strip, and (3) winding means for coiling said finished strip.

11. The apparatus of claim 8 wherein said slack accommodating rolls are disc-like and have deeply recessed grooves in their circumferential faces, said grooves accepting lateral deflections of said rod creating said slack.

* * * * *